United States Patent [19]

Fortenberry

[11] 4,148,424

[45] Apr. 10, 1979

[54] HOLDER FOR A WRITING INSTRUMENT

[76] Inventor: Herman W. Fortenberry, 1519 Veronica Pl., Santa Barbara, Calif. 93105

[21] Appl. No.: 761,887

[22] Filed: Jan. 24, 1977

[51] Int. Cl.[2] ..... B43K 23/00

[52] U.S. Cl. ..... 224/218; 15/443; 24/186; 24/198; 401/8

[58] Field of Search ..... 224/4 F, 5 R, 5 B, 28 R, 224/28 A, 28 B, 28 D; 24/3 R, 3 A, 10 R, 11 R, 11 CC, 11 CT, 11 FE, 169, 186, 198; 401/6, 8; 15/443

[56] References Cited

U.S. PATENT DOCUMENTS

| | | | |
|---|---|---|---|
| 235,520 | 12/1880 | Forsyth | 15/443 |
| 565,374 | 8/1896 | Yarbrough | 15/443 X |
| 1,206,976 | 12/1916 | Barth | 401/8 |
| 3,823,443 | 7/1974 | Takabayashi | 24/186 |
| 4,038,726 | 8/1977 | Takabayashi | 24/198 |

FOREIGN PATENT DOCUMENTS

| | | | |
|---|---|---|---|
| 320640 | 4/1919 | Fed. Rep. of Germany | 15/443 |
| 1225806 | 6/1960 | France | 24/169 |
| 171405 | 11/1934 | Switzerland | 24/11 C |
| 26937 of | 1897 | United Kingdom | 15/443 |
| 22531 of | 1907 | United Kingdom | 15/443 |

*Primary Examiner*—Trygve M. Blix
*Assistant Examiner*—Winston H. Douglas
*Attorney, Agent, or Firm*—Spensley, Horn & Lubitz

[57] ABSTRACT

The holder for a writing instrument provides a band adapted to completely encircle the person's hand about the palm area. A portion of the band is formed into a loop to define a writing instrument receptacle adapted to hold a writing instrument. When the band is attached about the palm area and appropriately adjusted, the writing instrument receptacle will hold the instrument with its major axis generally in line with the plane defined by the person's palm, the band and receptacle being sufficiently flexible to permit the instrument to be turned somewhat and comfortably held in the normal writing position between the person's fingers. Preferably the band is elastic and adjustable to fit the palm of different size hands, and the loop is defined by a clip that permits tension in the band to be transmitted to the loop and its size thereby adjusted automatically upon being placed about the person's palm to securely hold a writing instrument. A preferred form of buckle for attaching together the end portions of the band also is disclosed, the buckle preferably being injection molded of plastic material as a flat, unitary article.

9 Claims, 4 Drawing Figures

HOLDER FOR A WRITING INSTRUMENT

BACKGROUND OF THE INVENTION

This invention relates to a holder for a writing instrument, and more particularly to a holder adapted to encircle the palm area of a person's hand to hold a writing instrument in a convenient, nonobstructive position for ready use.

Many people in various activities repeatedly pick up and put down a pencil or other writing instrument. Since the instrument, between uses, easily can roll away or be covered by other material, it is not unusual that occasionally time must be spent searching for it. Moreover, in repetitive operations such as adding a number of columns of figures where the totals are to be recorded, appreciable time is consumed just in locating, picking up, using and then putting down the writing instrument so that the next column may be added.

For all of these reasons, it would be quite desirable to be able to attach the writing instrument to the user in a convenient location for ready accessibility. A number of structures have been devised to provide such an attachment. Some clip the instrument to the user by means of a cord; in some cases, the cord is retractable. Not only could the presence of the cord be annoying, but also if it is retractable the pressure it exerts on the instrument can quickly tire the user. Other such structures provide a band or clip to attach the instrument about the user's finger or hand. Many of these structures are uncomfortable in use, especially if the person's hand departs much from a normal size; they also are awkward and for the most part do not position the instrument at a natural writing angle.

An objective of this invention, accordingly, is to provide a holder for a writing instrument that is adjustable to comfortably fit the user's hand, whatever its size and shape, a holder which adapts to the size of the writing instrument and positions the writing instrument in a convenient fashion, ready for use at a natural writing angle. These and other objects will be apparent from the following description of a preferred embodiment of the invention.

SUMMARY OF THE INVENTION

The holder for a writing instrument provides a band adapted to completely encircle the person's hand about the palm area. A portion of the band is formed into a loop to define a writing instrument receptacle adapted to hold a writing instrument. When the band is attached about the palm area and appropriately adjusted, the writing instrument receptacle will hold the instrument with its major axis generally in line with the plane defined by the person's palm, the band and receptacle being sufficiently flexible to permit the instrument to be turned somewhat and comfortably held in the normal writing position between the person's fingers. Preferably the band is elastic and adjustable to fit the palm of different size hands, and the loop is defined by a clip that permits tension in the band to be transmitted to the loop and its size thereby adjusted automatically upon being placed about the person's palm to securely hold a writing instrument.

A preferred form of buckle for attaching together the end portions of the band also is disclosed, the buckle preferably being injection molded of plastic material as a flat, unitary article. Advantageously this buckle may include a base portion, means clamping one end portion of the band to the base portion, an intermediate portion attached to and overlying the base portion, the base and intermediate portions defining openings including an entrance slot and an exit slot for an intermediate portion of the band, a top portion overlying the intermediate and base portions of the buckle, and means attaching the top, intermediate, and base portions of the buckle together in their overlying relationship. Preferably these portions are molded with the intermediate and top portions hinged to the base portion, the buckle incorporating molded interlocking means in the base, intermediate, and top portions to attach the portions together as a unitary article.

BRIEF DESCRIPTION OF THE DRAWINGS

A preferred embodiment of the invention will be further described in connection with the accompanying drawings in which.

DETAILED DESCRIPTION OF THE PREFERRED EMBODIMENT

Figure 1:
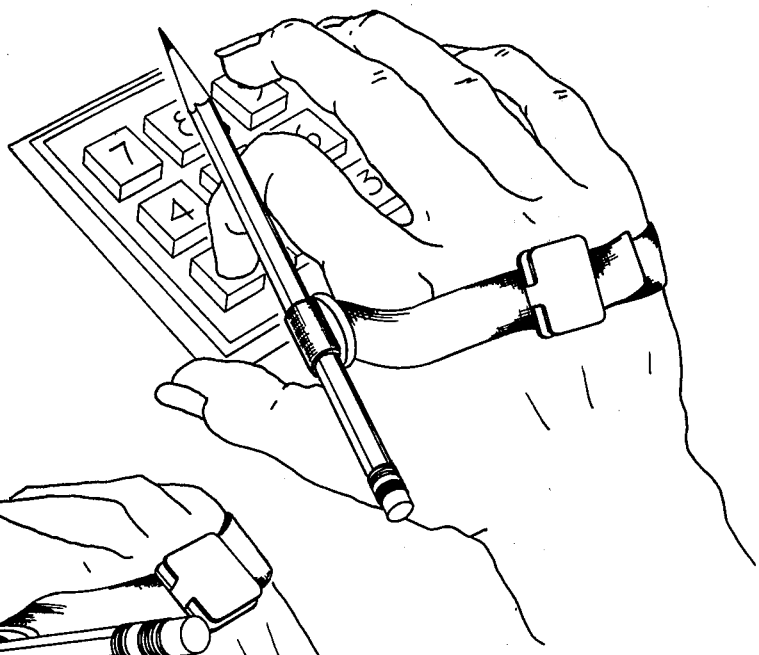
FIG. 1 is a perspective view showing the holder for a writing instrument in use.
Figure 2:
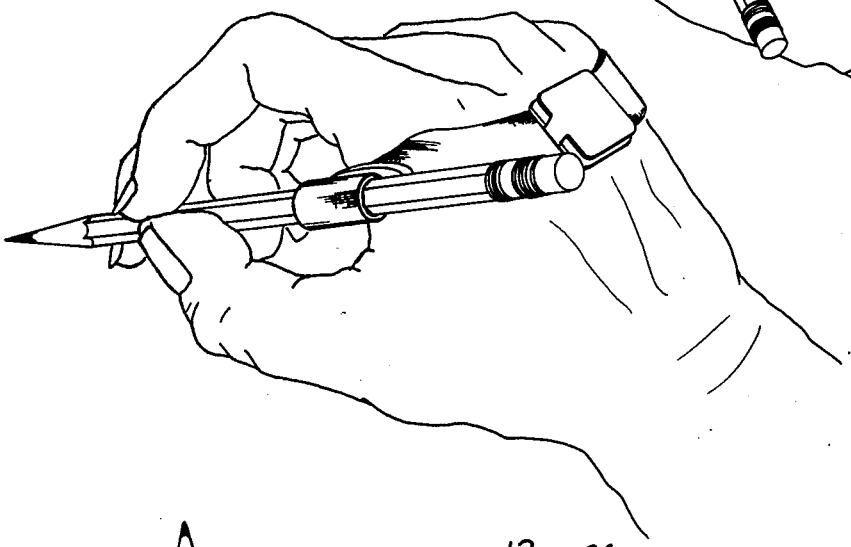
FIG. 2 is a perspective view showing the holder in a different position of use.

The holder for a writing instrument, in its preferred construction, is designed to be placed about the palm of a person's hand and to hold the writing instrument, illustrated as a pencil, with its major longitudinal axis generally in the plane defined by the person's palm. Thus, when the user is performing other operations, such as actuating the buttons of an adding machine as shown in FIG. 1, the holder will position the writing instrument in a convenient yet out-of-the-way manner. To use the writing instrument, all the person need do is to reach up with his index finger and bring the tip area of the instrument to bear against his thumb, in a normal writing position as illustrated in FIG. 2. The holder is sufficiently flexible (as will be described) to permit the instrument readily to rotate without appreciable restraint into this position. Upon completing the writing operation and releasing the instrument, the holder automatically causes the instrument to resume the convenient yet out-of-the-way position shown in FIG. 1.

Figure 3:
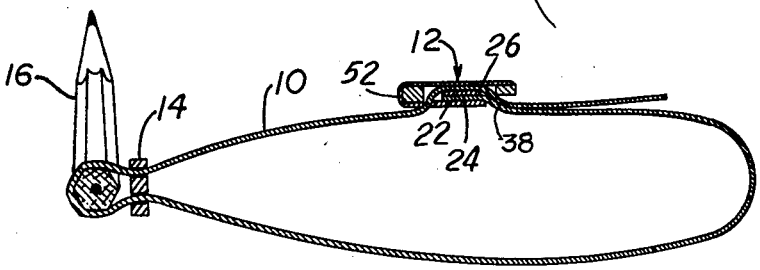
FIG. 3 is a view, mostly in cross-section, illustrating the construction of the holder.

The construction of the holder is best shown in FIG. 3. It consists of a band 10, preferably formed of a woven, elastic material approximately five-eights to three-quarters of an inch wide. The end portions of the band are received in, and linked together by, a buckle 12 which forms the band into a loop to completely encircle the wearer's palm area, as shown in FIGS. 1 and 2. The holder also includes a clip 14 through which the band passes to be formed into a second smaller loop that receives a writing instrument 16. Because the band passes through the clip, the tension inherent in the band when it is comfortably positioned about the user's palm, is transmitted through the clip to the smaller loop holding the writing instrument. Thus, the writing instrument will be comfortably yet securely held in the plane defined by the band, which plane in turn is defined by the user's palm. Buckle 12 may be employed to adjust the circumference of the loop encircling the user's palm, thereby to adjust the tension in the band to a comfortable yet snug level, considerably enhancing the user of the holder over extended periods and adapting the holder to be used by all people, whatever their palm size.

Figure 4:
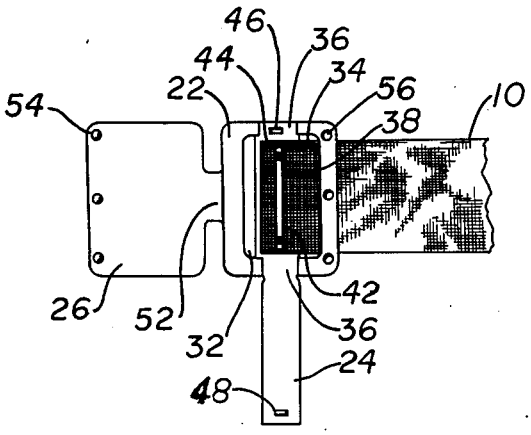
FIG. 4 is a plan view showing the buckle in its open position to illustrate its various component portions.

A preferred construction of the buckle is shown in FIG. 4. Conveniently it may be injection molded, because of its design, as a unitary article from a plastic material. The buckle includes three portions, a base portion 22, an intermediate portion 24, and a top portion 26. The base portion is formed to provide two slots 32 and 34 through which the band may pass. The center area 36 of the base is reduced in height sufficiently beneath the top surface of portion 22 to receive one end portion 38 of the band 10, and also to receive the intermediate portion 24 down over the end portion of the band, the top surface of the intermediate portion then lying in the approximate plane defined by the top surface of portion 22. A staple 42, or teeth 44, or both, may be employed to attach the end portion of the band to the base portion of the buckle. The intermediate portion then is folded down over the base portion to prevent the band from slipping over these teeth. A cooperating tooth 46 in the base portion and an eye 48 in the outer end of the intermediate portion are provided so that, when the intermediate portion is folded down on the base portion, the tooth projects through this opening and locks the intermediate portion to the base portion. The top portion, which may be formed with a hinge area 52 in a fashion similar to the hinge area attaching the intermediate portion to the base portion, also may be folded down over the intermediate and base portions, the top portion preferably including teeth 54 which interlock with openings 56 provided in the base portion to hold the top, intermediate and base portions together and form a unitary buckle. The other end of the band may be passed up through opening 32, over the top of the intermediate portion, then down through opening 38, thereby forming the band into a loop. Preferably the dimensions of the buckle are such that, when the top portion is folded down and attached to the other portions, it bears in the underlying section of the band with sufficient force to prevent it from slipping through the buckle. Thus, once the size of the loop formed by the band has been adjusted by the user to fit his palm and the buckle closed, the band need not be adjusted again by the user.

Obviously the band may be used to hold any sort of writing instrument such as a pencil, pen, chalk holder or scribe point. It is found to be particularly useful by those performing operations that require the repeated, even though momentary, use of a writing instrument. It has been found, in the preferred design, to be comfortable in use even after extended periods of wear. The width of the elastic band, in the preferred design, has been found sufficient to hold the writing instrument in a convenient yet out-of-the-way position, as in FIG. 1. It is especially important that the instrument be held in an out-of-the-way position for the point of the instrument then will not endanger the user should he absentmindedly scratch his head. This attachment, however, permits the writing instrument to be rotated by an easy and natural motion into the position in which it is used, as shown in FIG. 2, without difficulty and without requiring appreciable force, for this would tire the user should he need to use the writing instrument for an extended period. Also, when in use the instrument is held by the holder at a natural writing angle, another important advantage of this simple structure. Advertising or promotional matter may be carried by the top of the buckle, or imprinted on the top of the buckle, or on the top of the band, adapting the holder to be used as a promotional item if desired. Obviously the holder, in its preferred form, is quite simple in construction and economical in cost.

While a preferred embodiment of the holder has been described, and a preferred embodiment of the buckle used with that holder also has been described, variations will be apparent to those skilled in this field. Accordingly, the scope of the invention is not limited to the preferred embodiments described, but rather is defined by the following claims.

I claim:

1. A holder for a writing instrument comprising:

a wide, flexible band adapted to completely encircle a person's hand about the palm area, and clip means forming a portion of the band into an adjustable loop to provide a writing instrument receptacle adapted to hold the writing instrument and, when the band is attached about a person's hand, for generally holding the instrument with its longitudinal axis in line with the plane defined by the palm area, the band communicating with the loop through the clip means whereby tension in the band when about a person's hand is transmitted to the loop forming the writing instrument receptacle, the band and the receptacle being sufficiently flexible to permit the instrument to be turned and comfortably held in a normal writing position between a person's fingers, the band being sufficiently wide to, when positioned about a person's palm, hold the writing instrument generally in line with the plane defined by the palm when not in the normal writing position.

2. A holder as set forth in claim 1 in which the band and receptacle are adjustable to accommodate palms of different size and writing instruments of different size.

3. A holder as set forth in claim 2 in which the band is formed of an elastic material and is sufficiently wide to, when positioned about a person's palm, hold the writing instrument generally in line with the plane defined by the palm.

4. A holder as set forth in claim 3 including a buckle, both end portions of the band being attached together by the buckle the buckle permitting the end portions of the band to be adjusted relative to one another to adjust the size of the band to the user's palm.

5. A holder as set forth in claim 4 in which the buckle includes a base portion.

means clamping one end portion of the band to the base portion of the buckle, the buckle also including an intermediate portion attached to and overlying the base portion, the base and intermediate portions of the buckle defining openings including an entrance slot and an exit slot for an intermediate portion of the band, the buckle further including a top portion overlying the intermediate and base portions of the buckle, and means attaching the top, intermediate and base portions of the buckle together in an overlying relationship.

6. A holder as set forth in claim 5 in which the buckle is molded of plastic material as a flat, unitary article with the intermediate and top portions hinged to the base portion, the buckle including molded interlocking means in the base, intermediate, and top portions to provide said attachment means.

7. A buckle for adjustably attaching portions of a band together, the buckle including:

a base portion, means for attaching one end portion of a band to the base portion including an intermediate portion attached to and overlying the base portion, the base and intermediate portions of the buckle defining openings including an entrance slot and an exit slot for an intermediate portion of the band, the buckle further including a top portion overlying the intermediate and base portions of the buckle, the intermediate and top portions each being hinged to the base portion, the axes of the hinges being perpendicular to one another, and means attaching the top, intermediate and base portions of the buckle together in their overlying relationship.

8. A buckle is set forth in claim 7 in which the buckle is molded of plastic material as a flat, unitary article, the buckle including molded interlocking means in the base, intermediate, and top portions to provide said attachment means.

9. A buckle as set forth in claim 8 in which the intermediate portion is formed as a bar overlying the end portion of a band and clamping it to the base portion, the base portion including said slots and a recess between them for receiving said band end portion and bar, the top surface of said bar when received in the slot provided in the base portion being generally co-planar with the top surface of the base portion, the intermediate portion being hinged to the base portion at the side of the base portion to extend generally transversely across the base and generally perpendicular to the path defined by a band end portion attached to the base.

* * * * *